United States Patent [19]

James

[11] Patent Number: 4,777,741

[45] Date of Patent: Oct. 18, 1988

[54] MOLDED ATHLETIC FOOTWEAR

[76] Inventor: Laurence H. James, 166 Byram Shore Rd., Greenwich, Conn. 06830

[21] Appl. No.: 44,195

[22] Filed: Apr. 30, 1987

[51] Int. Cl.[4] ..... A43B 5/00; A43B 5/16; A43B 1/14; A43C 11/00

[52] U.S. Cl. ..... 36/114; 36/50; 36/87; 36/115

[58] Field of Search ..... 36/115, 117–121, 36/114, 113, 129, 87, 50

[56] References Cited

U.S. PATENT DOCUMENTS

| | | | |
|---|---|---|---|
| 2,494,964 | 1/1950 | Rome | 36/117 |
| 3,613,271 | 10/1971 | Geller | 36/87 X |
| 3,654,670 | 4/1972 | Baso | 36/117 X |
| 3,939,583 | 2/1976 | Daumann | 36/115 |
| 4,384,413 | 5/1983 | Bourque | 36/115 |
| 4,467,538 | 8/1984 | Olivieri | 36/121 |
| 4,476,639 | 10/1984 | Zaccaria | 36/114 |

*Primary Examiner*—James Kee Chi

*Attorney, Agent, or Firm*—Grimes & Battersby

[57] ABSTRACT

An article of molded athletic footwear is provided in the form of a skate, running shoe or the like. The article of footwear comprises a molded, substantially rigid, lower shell portion which is adapted to receive and substantially encase the sole, toe and heel of a wearer. The instep portion of the lower shell is open to permit access to and from the interior of the shell portion. A molded, semi-rigid tongue is further provided which is integral to the shell adjacent the open instep. The tongue includes a center instep support and at least one pair of complimentary wing portions extending outwardly from the center instep support. The complimentary wing portions are adapted to wrap around a portion of the shell portion and secure together to secure the tongue over part of the shell portion and the wearer's foot. A pair of complimentary securing devices are provided at the outer ends of each of the wing portions and are adapted to secure one wing to the other wing.

12 Claims, 5 Drawing Sheets

MOLDED ATHLETIC FOOTWEAR

BACKGROUND OF THE INVENTION

The present invention relates generally to molded athletic footwear and, more particularly, to molded a footwear integrated with ice skates, roller skates, or running shoes, and which include a molded, lower shell and a semi-rigid, upper tongue integrally to the lower shell which is adapted to be quickly and easily secured to the shell, preferably by the use of ratchet-type closure devices.

Heretofore, integrated ice skates, roller skates and other athletic footwear utilized relatively flexible upper portions made, for example, from leather or a synthetic material with closure means for permitting the upper portion to conform to the foot and secure the foot therein.

With the development of synthetic materials and the refinement of molding processes, there has been a recent trend toward molded athletic footwear such as, for example, ski boots and ice skates and running shoes which are molded from synthetic materials. In some sports, particularly skiing and skating molded footwear has become increasingly popular because of the security and protection accorded the foot. The molded footwear conforms to the foot, thus protecting it from outside forces. Molded footwear does, however, present certain problems, particularly with respect to the manner in which the various articles of the footwear are secured about the foot of the wearer and the closure systems which may be used in conjunction therewith.

Perhaps the most common type of closure system for all types of footwear, including athletic footwear, has been the classic lace-type, closure system. An example of footwear integrated with ice skates which incorporates such a lace-type closure system is described, for example, in U.S. Pat. No. 4,509,276 which issued on Apr. 9, 1985 to R. Bourque. Lace-type closure systems, while used extensively in athletic footwear, present certain problems, particularly to the competitive athlete whose footwear must fit snuggly, yet not too tightly. In order to achieve such a snug, tight fit, strenuous pulling forces must be applied to the laces whch, oftentimes, leads to material breakage. Moreover, such lace type closure systems are not practical when used in combination with such molded footwear.

Other types of closure systems have been used frequently in non-athletic footwear. For example, children's sneakers frequently use Velcro-type fastening devices to replace conventional lace-type closure systems.

U.S. Pat. No. 4,107,856, which issued on Aug. 22, 1978 to R. Bourque, discloses a fast closing, athletic boot which includes a pivotably mounted upper leg portion. The closure means provided in Bourque is, however, generally unacceptable for use in athletic competition as it may be tightened only at a point above the ankle and, therefore, does not provide a snug, tight overall closure about the athlete's foot within the shoe or boot.

As described above, the prior art has yet to provide an article of molded athletic footwear which includes securing means which are capable of providing a secure, overall snug-tight fit for the wearer while remaining relatively easy to put on and take off.

Against the foregoing background, it is a primary object of the present invention to provide molded athletic footwear which provides an overall snug, secure fit for the wearer.

It is another object of the present invention to provide athletic footwear which is relatively easy to put on and take off and has consistent foot security in both tightness about the foot and protection of the foot.

It is still another object of the present invention to provide athletic footwear which is relatively inexpensive to manufacture.

It is yet still another object of the present invention to provide athletic footwear integrated with ice skate hardware.

Another object is to provide integrally molded athletic footwear which may be integrated with ice skates or roller skates.

It is still yet another object of the present invention to provide athletic footwear in the form of a running shoe.

Still a further object is to provide integrally molded athletic footwear in the form of a running shoe which retains an overall tight fit.

SUMMARY OF THE INVENTION

To the accomplishments of the foregoing objects and advantages, the present invention, in brief summary, comprises an integrally molded article of athletic footwear which may be integrated with ice skates or roller skates to form what is commonly referred to as ice skates or roller skates. Such footwear may also be molded onto other athletic footwear such as a running shoe or the like. The article of footwear comprises a molded, substantially rigid, lower shell portion which is adapted to receive and substantially encase the sole, heel and toe of a wearer. The instep portion of the lower shell is open to permit access to and from the interior of the shell portion. A molded, semi-rigid, tongue portion is further provided which is integrated with the shell adjacent the open instep. The tongue portion includes a center instep support and at least one pair of complimentary wing portions extending outwardly from the center instep support. The complimentary wing portions are adapted to wrap around the shell portion of the footwear and be secured about the wearer's foot or ankle. A set of securing devices are provided at the outer ends of each of the wings and are adapted to secure one wing to the other wing thereby securing the wings of the tongue portion about the shell portion. The securing devices are adjustable and serve to securely retain the foot within the footwear.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DESCRIPTION OF THE PREFERRED EMBODIMENTS

Figure 5:
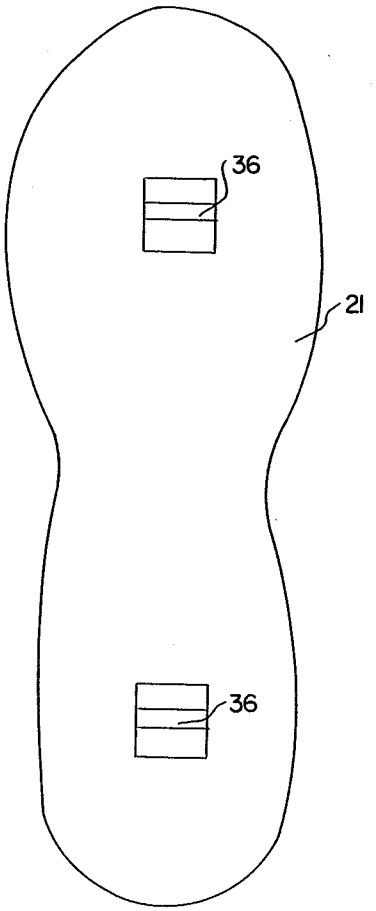
FIG. 5 is a bottom view of the footwear illustrated in FIG. 1 with the skate hardware and wing portions removed.

Referring now to the drawings and, in particular, to FIGS. 1 to 5 thereof, the article of athletic footwear of the present invention is illustrated as an ice skate 10 including a blade portion 15 which is attached to a boot portion 20 by one or more couplers 18. It will be appreciated that the article of molded footwear of the present invention can also be used for other applications such as walking shoes, sandals or any footwear. The blade portion 15 is illustrated in conventional design and includes a blade 19 and front, center and rear support couplers 18. As shown in FIG. 5, a pair of grooves 36 are provided at the bottom 21 of the boot portion 20 which are adapted to receive adjustable studs (not shown) which extend from each of the couplers 18 for securing the blade portion 15 to the boot portion 20.

Figure 1:
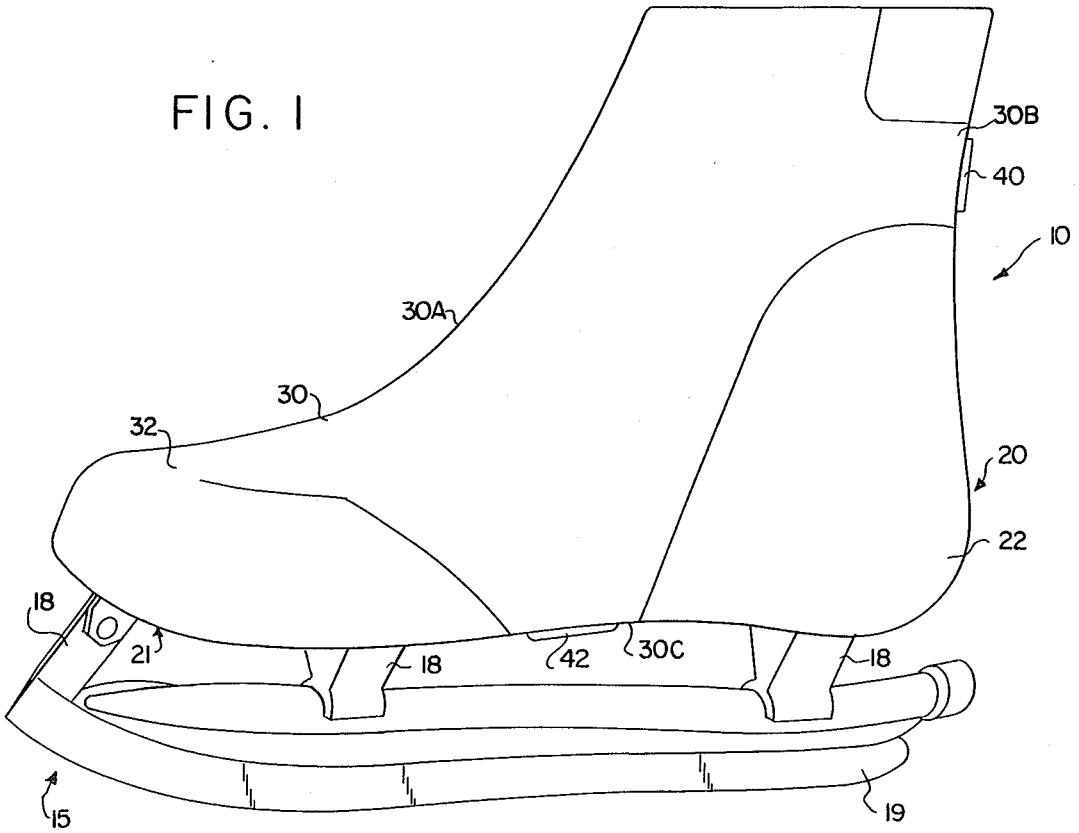
FIG. 1 is a perspective side illustration of the footwear of the present invention integrated with ice skate hardware forming an unitary ice skate.

As shown in FIG. 1, the boot portion 20 includes an integrally molded, lower shell 22 adapted to receive and retain, in the interior thereof, the foot of a wearer. The shell 22 is preferably molded from rigid or semi-rigid thermoplastic material such as, for example, polyvinyl chloride and may include appropriate padding and the like. In a particularly preferred embodiment, the shell 22 is injection molded. The shell 22 is open at the instep area to permit easy access to the interior of the shell 22.

The tongue 30 is provided for securely retaining the foot within the shell 22 when closed over the shell 22. The tongue 30 is integrally molded with the shell 22, being integral at 32, essentially forming a flexible hinge or bridge between the tongue and the shell. The flexible bridge 32 permits the tongue 30 to hinge open, exposing a substantial, unencumbered portion of the interior of the shell 22 so that the foot may be easily inserted into and/or removed from the shell 22 with ease and comfort. Such substantial, unencumbered exposure of the interior of the shell 22 by the open tongue 30 permits insertion of the foot into the shell 22 without cramping, crushing or wrinkling socks covering the inserted foot so that any intimate foot covering may be fold-free and/or wrinkle-free prior to securing the footwear about the foot. The tongue 30 includes the connecting bridge 32 and a center instep support 30A which extends to the upper portion of the footwear when the tongue 30 is closed, supporting and protecting the instep and upper portion of the foot in the high-top footwear form of the invention. In the low cut shoe form, as illustrated in FIG. 6, the tongue portion extends lower on the foot permitting more exposure of the foot.

In the high-top shoe embodiment, the instep portion 30A of the tongue 30 is adapted to conform, cover, protect and be positioned above and over the instep of the wearer's foot when the foot is contained in the interior of the shell 22 and the tongue 30 is closed over the foot. The center instep 30A extends into a complimentary pair of upper wings 30B which are provided to wrap around the upper portion of the shell 22, in the region of the ankle.

Figure 3:
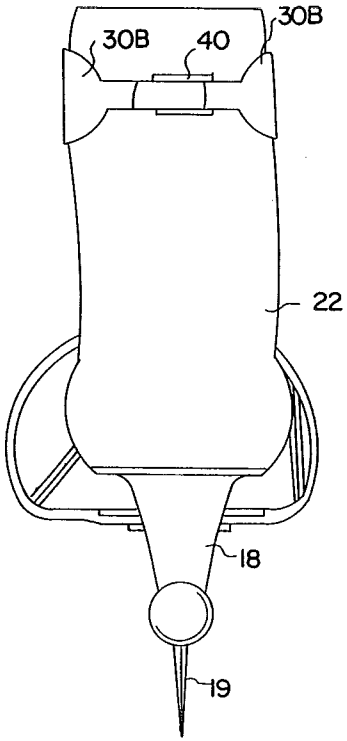
FIG. 3 is a rear view of the ice skate of FIG. 1.
Figure 2:
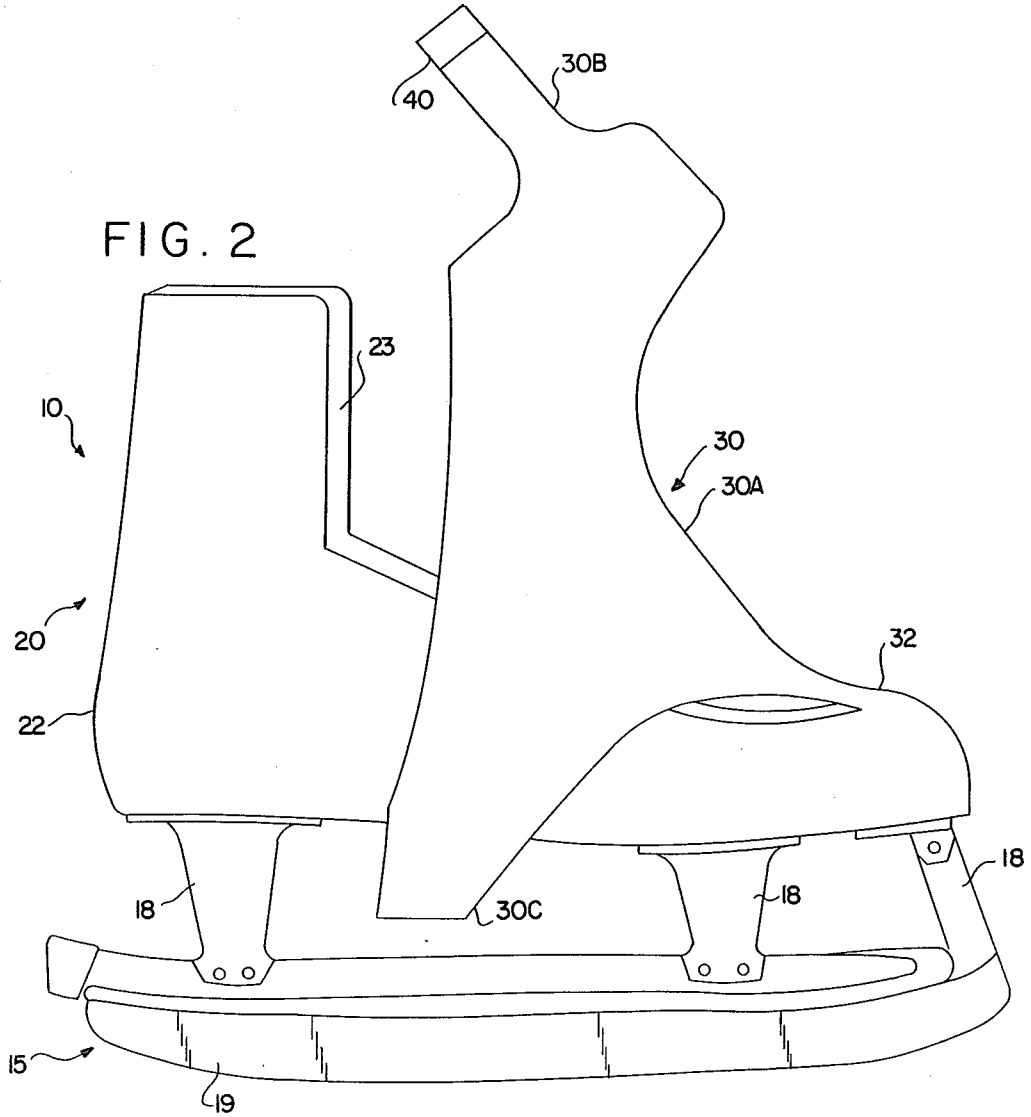
FIG. 2 is a side view of the ice skate of FIG. 1 with the instep portion illustrated in an open position.
Figure 4:
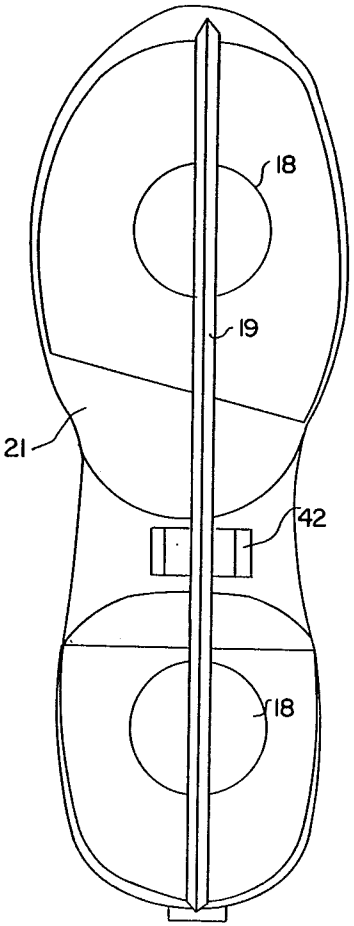
FIG. 4 is a bottom view of the ice skate of FIG. 1.
Figure 6:
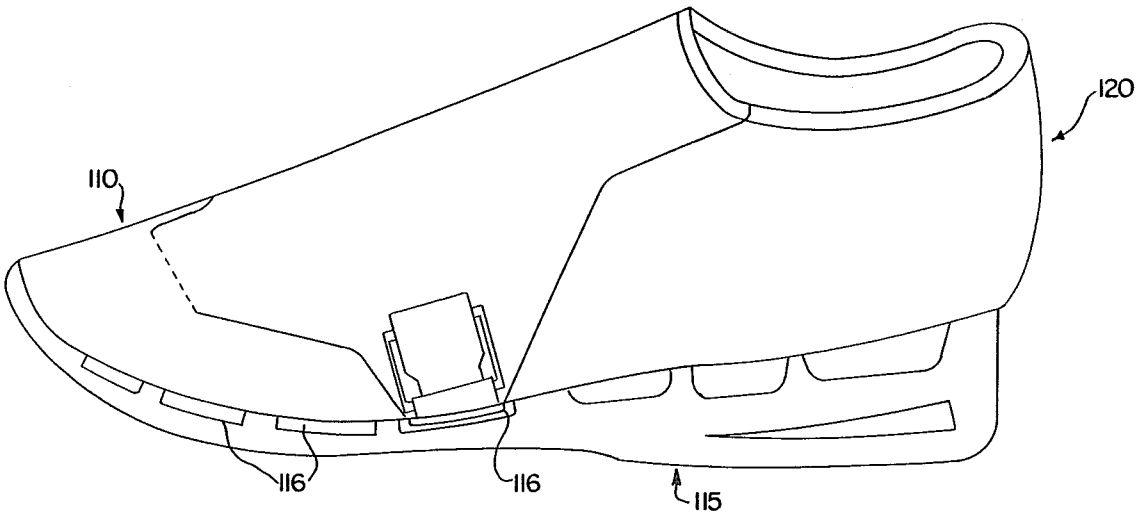
FIG. 6 is a side, perspective view of the running shoe of the present invention; in the form of a running shoe.

In the high-top shoe embodiment in FIGS. 1, 2 and 3, and in the low cut or Oxford type shoe of FIG. 6, the tongue 30 extends at its sides into a pair of complimentary lower or bottom wings 30C which extend outwardly from the center instep portion 30A to wrap around lower and under portions of the foot further securing and protecting part of the arch and the under side of the foot.

The shape, configuration and overall embracing characteristics of the tongue 30 permit it to be closed over the instep and conform to the shape of the instep of the wearer thereby providing uniform support of the foot as well as a high degree of protection without tight spots or spotted tighteners when the tongue 30 is closed. Whe the tongue 30 is substantially opened, the full upper extent of the foot and almost all of the side of the foot are exposed permitting easy entry and/or removal of the wearer's foot into and out or the shell 22.

A set of fastening or securing devices 40 are provided at the outer ends of the upper wings 30B for securing the wings about the upper portion of the footwear. One set or pair of securing elements or devices 40 is connected to each of the upper wings 30B, respectively, so that the upper wings 30B are secured about the ankle portion of the footwear. Another set or pair of securing elements or devices 42 are provided at the outer ends of the lower wings 30C for securing the lower wings 30C about the under portion of the footwear. One element of the set or pair of securing elements device 42 is connected to each end, respectively, of the lower wings 30C so that the lower wings 30C may be secured about the bottom portion of the footwear.

Figure 8:
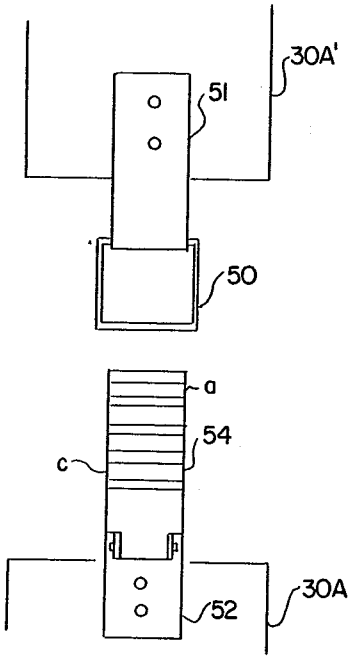
FIGS. 8 and 9 illustrate closure means which may be used in conjunction with the athletic footwear of the present invention.
Figure 9:
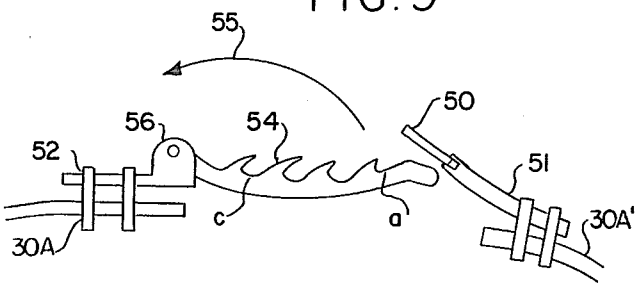

Preferably, each set or pair of securing device is adjustable so that the footwear will accommodate and/or permit a wide range of foot shapes of sizes while still obtaining comfortable, secure and uniform fitness of the footwear. One form of fastening device is illustrated in FIG. 8 and 9. A ring or loop 50 is secured at the end of a strap 51 which is connected to one of the wings 30B, for example. The ring 50 latches in one of the grooves of the lever 54 and pulling in its direction of arrow 55, the ratchet lever 54 passes across the pivot 56 thereby snapping the tongue closed. The loop 50 can be located in any one of several grooves provided in the ratchet lever 54. If the loop 50 is located in the closest groove, "A", the lever 54 is pulled a longer distance over the pivot. If the loop 50 is located in the furthest groove, "C", the loop 50 is pulled a shorter distance over the pivot. It will be appreciated that many different closures may be used, if desired. A loop and lever device will serve to secure the wings around the shell, however the ring and the tongue is preferred because it is easy to operate for closing and opening alike. It is highly adjustable and, when closed, snaps closed securely.

It will be appreciated that a wearer uses the article of footwear as illustrated in FIGS. 1 and 2 in the following manner. The wearer first bends back the tongue 30 at the bridge 32 to permit access to the interior 23 of the shell 22. The foot is inserted into the interior 23 of the shell 22, so as to lie fully inside the shell. The tongue 30 is bent at the bridge 32, of the shell, drawing the instep portion 30A over the shell 22. The outer ends of the upper wings 30B are wrapped around the outside of the ankle portion of the shell 22 and the outer ends of the lower wings 30*c* are wrapped around the outside or bottom 21 of the shell 22, between the brackets 18. The set of securing devices 40 and 42 which are provided at the outer ends of the upper wings 30B and the lower wings 30C are then engaged to positively secure the tongue 30 to the shell 22.

Figure 7:
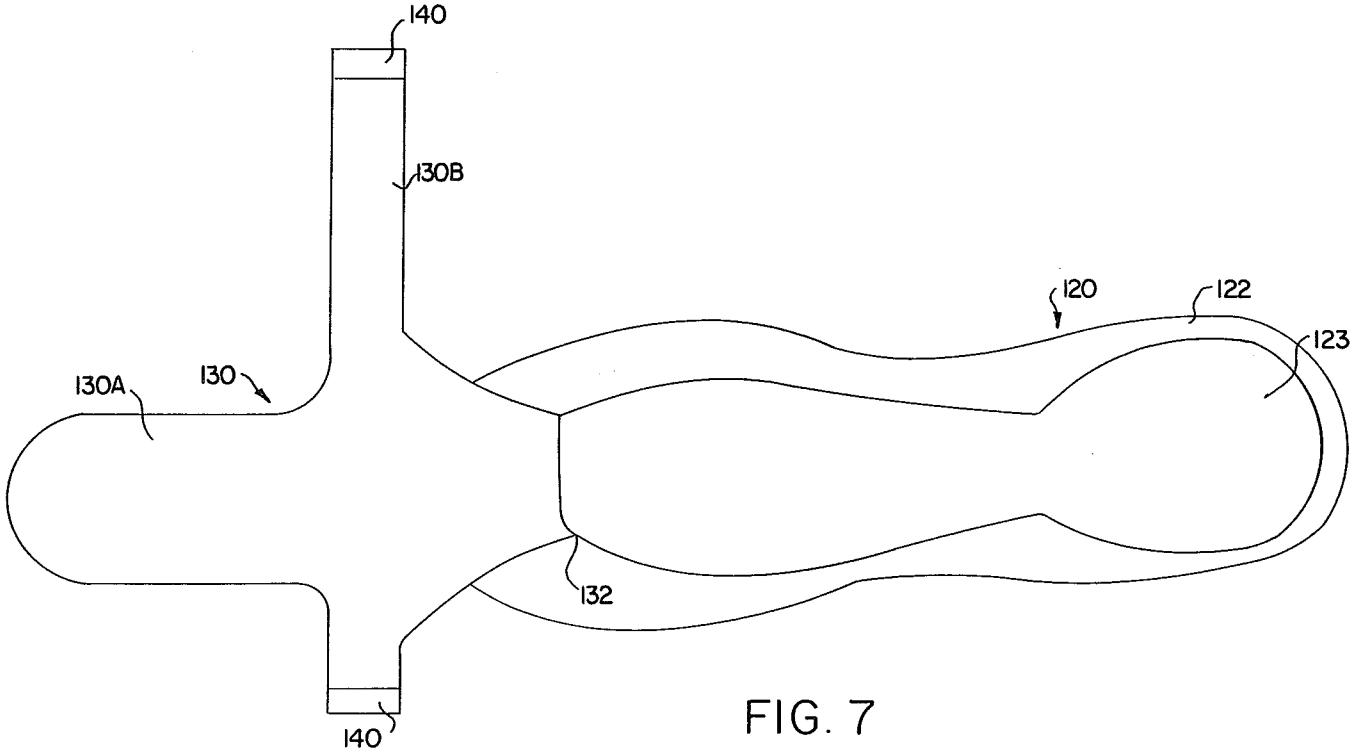
FIG. 7 is a top view of the running shoe of the FIG. 6 in an open form.

FIGS. 6 and 7 illustrate an alternative embodiment of the article of footwear of the present invention particularly in the form of a low cut shoe 110, suitable for running. The running shoe may, if desired, also be provdied in a high-top form. The running shoe 110 includes an upper portion 120 connected at its bottom 115 to a shock absorbing sole portion 116. One or more lateral cut-out portions 116 are provided in the sole portion 115 to assist in shock absorption for the running shoe 110.

The upper portion 120 of the shoe 110, as shown in greater detail in FIG. 7, includes an integrally molded shell 122 which is adapted to receive and retain, in its interior 123, a wearer's foot. The shell 122 is preferably molded from a rigid or semi-rigid thermoplastic material such as, for example, polyvinyl ohloride. In a particularly preferred embodiment of low cut footwear, the shell 122 may be injection molded. The interior 123 of the shell 122 is open at the tongue or instep area to permit easy insertion of the foot into, and removal of the foot from the footwear.

A tongue 130 is provided for positively retaining the foot within the shell 122. The tongue 130 is integrally attached to the shell 122 by a bridging hinge or self-hinge 132. The tongue 130 includes a center instep 130A which is adapted to conform to and be positioned above the wearer's instep thereby supporting the instep while positively retaining the wearer's foot therein. A complimentary pair of center wings 130B are provided which extend outwardly from the center instep 130A. A set of securing devices 140 are provided at the outer ends of the center wings 130B. At least one of the outer ends of the center wings 130B with the securing devices 140 contained thereon is adapted to pass through one of the lateral cut-outs 116 in the sole portion 115 of the shoe 110. The tongue 130 is thus secured in place over the shell 122 by engaging the set securing devices 140.

Having thus described the invention with particular reference to the preferred forms thereof, it will be obvious that various changes and modifications may be made therein without departing from the spirit and scope of the invention as defined by the appended claims.

I claim:

1. A molded article of athletic footwear comprising:

a molded, substantially rigid, shell portion adapted to receive and substantially encase the toe, sole and heel of a foot of a wearer, said shell portion having an enclosed heel, toe and sole and an open instep area to permit access to the interior of the shell portion;

a molded, semi-rigid, tongue integral with said shell portion at said instep area, said tongue having an elongated center instep support and at least one pair of complimentary wing portion extending outwardly from an approximate central location along the length of said center instep support, said complimentary wing portions adapted to wrap around a portion of said sole of said shell portion; and a pair of securing devices provided at the outer ends of said wing portions, said securing devices being adapted to secure said wing portions together to thereby secure the foot of the wearer in said footwear.

2. The article of claim 1, wherein said securing device comprises a pair of ring and grooved lever snap-over fasteners, with each part, respectively, provided at the outer ends of the wing portions, respectively.

3. The article of claim 1, wherein said tongue is connected to the shell portion by self-hinge.

4. An ice skate comprising:

a molded, substantially rigid, lower shell portion adapted to receive and substantially encase the sole, heel and toe of a foot of a wearer, said lower shell portion having an enclosed heel, toe and bottom and an open instep area to permit access to the interior of the shell portion;

an ice skate blade secured to the exterior of the bottom of said shell portion by at least front and rear couplers;

a molded, semi-rigid, tongue integral with said shell portion at said instep area, said tongue having an elongated center instep support portion and at least one pair of complimentary center wing portions extending outwardly from an approximate central location along the length of said center instep support, said complimentary center wing portions adapted to wrap around said shell portion between said shell portion and said ice skate blade; and a pair of complimentary securing devices provided at the outer ends of said center wing portions, said securing devices being adapted to secure said center wing portions together to thereby secure said tongue to said shell portion.

5. The ice skate of claim 4, wherein said tongue further includes at least a one pair of complimentary upper wing portions extending outwardly from an approximate end location along the length of said tongue said complimentary upper wing portions adapted to wrap around said shell portion in the region of an ankle of the foot of said wearer and a pair of complimentary securing devices provided at the outer ends of each of said wing portions adapted to secure said upper wing portions together, encircling said ankle of said foot of said wearer.

6. The molded ice skate of claim 4, wherein said securing devices are ratchet-type snap over fastening devices.

7. An ice skate having footwear coupled integral with ice skate hardware, said ice skate comprising:

a molded, substantially rigid lower shell portion adapted to receive and substantially encase the foot of a wearer, said lower shell portion having substantially enclosed toe, heel and bottom portions for supporting the foot of a wearer and an open instep portion for permitting access to said toe, heel and bottom portions;

ice skate hardware including a skate blade and skate blade retaining and coupling members for securing said ice skate hardware to the exterior of the bottom of said shell portions; and a molded, semi-rigid tongue integral with said shell portion at an instep area, said tongue having an elongated center instep support portion and at least one pair of complimentary wing portions extending from an approximate central location along the length of said center instep support, said wing portions adapted to wrap around a portion of said bottom portion of said shell portion for securing said tongue at least over said open instep portion for securing the foot of said wearer in said footwear.

8. The ice skate of claim 7 wherein said tongue further includes a second pair of complimentary wing portions extending from said tongue at an approximate end location along the length thereof, said secure pair of wing portions adapted to wrap around a secure portion of said shell portions distinguishable from said bottom portion for securing said tongue at least over said foot of said foot of said wearer from another point on said footwear.

9. The ice skate of claim 7 wherein said footwear further includes a two element set of securing devices with one element of said set secured to one wing portion of said at least one pair of complimentary wing portions and another element of said two element set secured to the other wing portion of said at least one pair of complimentary wing portions for securing said one wing portion to said other wing portion about said bottom portion of said shell.

10. The ice skate of claim 8, further including first and second sets of securing devices one element of said first set is coupled to one wing portion of said at least one pair of wing portions and another element of said first set coupled to the other wing portion of said at least one pair of wing portions to each other around said bottom portion of said shell portion for securing said wing portions together about said bottom portion of said shel portion.

11. The ice skate of claim 10, wherein one element of said second set is coupled to one wing portion of said second pair of complimentary wing portions and another element of said second set is coupled to the other wing portion of said second pair of wing portions for securing the wing portions of a pair to each other around said second portion of said shell portion different from said bottom portion.

12. A molded shoe comprising:

a molded, substantially rigid, lower shell portion adapted to receive and substantially encase the sole and heel of a wearer, said lower shell portion having an enclosed heel, toe and sole and an open instep area to permit access to the interior of the shell portion;

a sole portion secured to the bottom of said shell portion, said sole portion including at least one lateral cut-out portion extending through the thickness thereof;

a molded, substantially rigid, tongue integral with said shell portion at said instep area, said tongue having a center instep support portion, and being semi-rigid at said instep area, and at least one pair of complimentary center wing portions extending outwardly from said center instep support, said complimentary center wing portions adapted to wrap around said shell portion through said lateral cut-out portion in said sole portion; and a pair of matable securing devices provided at the outer ends of each of said center wing portions respectively, said securing devices being adapted to couple together and secure said center wing portions together to thereby secure said tongue to said shell portion.

* * * * *

UNITED STATES PATENT AND TRADEMARK OFFICE

CERTIFICATE OF CORRECTION

PATENT NO. : 4,777,741

DATED : 10/18/88

INVENTOR(S) : Laurence H. James

It is certified that error appears in the above-identified patent and that said Letters Patent is hereby corrected as shown below:

Column 1, Line 6
omit "a" insert -- athletic --.

Column 4, line 14
change "or" to -- of --.

Column 4, Line 29
change "device" to -- devices --.

Column 4, Line 31
after "foot shapes" omit "of" insert -- and --.

Column 5, Line 3
change "provdied" to -- provided --.

Column 5, Line 54 (Claim 1, Line 11)
change "portion" to -- portions --.

UNITED STATES PATENT AND TRADEMARK OFFICE

CERTIFICATE OF CORRECTION

PATENT NO. : 4,777,741

DATED : 10/18/88

INVENTOR(S) : Laurence H. James

It is certified that error appears in the above-identified patent and that said Letters Patent is hereby corrected as shown below:

Column 1, Line 44
change "whch" to —which —.

Column 4, Line 11
change "Whe" to —When —.

Column 5, Line 14
change "ohloride" to — chloride —.

Column 6, Line 2 (Claim 3, line 2)
after "by" insert — a —.

Column 6, Line 28 (Claim 5, Line 2)
after "least" omit — a —.

Column 7, Line 22 (Claim 10, Line 8)
change "shel" to — shell —.

Signed and Sealed this

Twenty-sixth Day of June, 1990

*Attest:*

HARRY F. MANBECK, JR.

*Attesting Officer*

*Commissioner of Patents and Trademarks*